US012044088B2

(12) United States Patent
Alkuhaili et al.

(10) Patent No.: US 12,044,088 B2
(45) Date of Patent: Jul. 23, 2024

(54) WELLBORE CLEANOUT MAGNET TOOL

(71) Applicant: Saudi Arabian Oil Company, Dhahran (SA)

(72) Inventors: Ahmed A. Alkuhaili, Al Khobar (SA); Mohammed T. Alsharif, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 1 day.

(21) Appl. No.: 17/720,030

(22) Filed: Apr. 13, 2022

(65) Prior Publication Data

US 2023/0332486 A1 Oct. 19, 2023

(51) Int. Cl.

| | |
|---|---|
| ***E21B 31/06*** | (2006.01) |
| ***E21B 27/00*** | (2006.01) |
| ***E21B 31/08*** | (2006.01) |
| ***E21B 41/00*** | (2006.01) |

(52) U.S. Cl.
CPC ..... *E21B 31/06* (2013.01); *E21B 27/00* (2013.01); *E21B 31/08* (2020.05); *E21B 41/0078* (2013.01)

(58) Field of Classification Search
CPC ..... E21B 27/00; E21B 31/08; E21B 31/06; E21B 37/00; E21B 34/06
See application file for complete search history.

(56) References Cited

U.S. PATENT DOCUMENTS

| | | | | |
|---|---|---|---|---|
| 8,453,724 | B2 | 6/2013 | Zhou | |
| 8,714,260 | B2 | 5/2014 | Knobloch et al. | |
| 9,109,417 | B2 | 8/2015 | Leiper et al. | |
| 2015/0192000 | A1* | 7/2015 | Cooper | E21B 31/06 166/243 |
| 2021/0246762 | A1* | 8/2021 | Paton | E21B 31/06 |
| 2021/0270108 | A1* | 9/2021 | Garcia | E21B 37/00 |

FOREIGN PATENT DOCUMENTS

| | | |
|---|---|---|
| WO | WO 2014167315 | 10/2014 |

* cited by examiner

*Primary Examiner* — George S Gray
(74) *Attorney, Agent, or Firm* — Fish & Richardson P.C.

(57) ABSTRACT

A wellbore cleanout magnet tool includes a housing and a door positioned within the housing. The housing can be connected to a wellbore tubing. The housing defines an interior volume and an opening on a circumferential surface of the housing. The door is positioned within the housing. The door can transition between an open position in an absence of wellbore fluid flow through the housing and a closed position in a presence of the wellbore fluid flow through the housing. A magnet is disposed in the interior volume. In the absence of the wellbore fluid flow through the housing, the door exposes the opening and the magnet to an environment outside the housing. In the presence of the wellbore fluid flow through the housing, the door closes the opening on the circumferential surface of the housing and isolates the magnet from the environment.

19 Claims, 6 Drawing Sheets

WELLBORE CLEANOUT MAGNET TOOL

TECHNICAL FIELD

This disclosure relates to wellbore operations and specifically to wellbore cleaning operations.

BACKGROUND

Operations for hydrocarbon development involve forming wellbores in subterranean zones (e.g., a formation, a piece of a formation or multiple formations). Certain wellbore operations can result in debris inside the wellbore. For example, when drilling a multilateral wellbore from a main wellbore, the act of milling a window through a metal casing can cause debris to fall into the wellbore. In another example, the use of chemicals to perform certain wellbore operations can also result in debris being left behind in the wellbore. Some of the debris can include magnetic items that can be removed from within the wellbore by lowering a magnetic cleanout tool into the wellbore.

SUMMARY

This specification describes technologies relating to a wellbore cleanout magnet tool. Certain aspects of the subject matter described here can be implemented as a wellbore tool assembly. The assembly includes a housing and a door positioned within the housing. The housing is configured to be connected to a wellbore tubing. The housing defines an interior volume and an opening on a circumferential surface of the housing. The door is positioned within the housing. The door is configured to transition between an open position in an absence of wellbore fluid flow through the housing and a closed position in a presence of the wellbore fluid flow through the housing. A magnet is disposed in the interior volume. In the absence of the wellbore fluid flow through the housing, the door exposes the opening on the circumferential surface of the housing and the magnet to an environment outside the housing. In the presence of the wellbore fluid flow through the housing, the door closes the opening on the circumferential surface of the housing and isolates the magnet from the environment.

An aspect, combinable with any other aspect, includes the following features. The door is configured to slide axially relative to the housing in a first direction to transition the door from the open position to the closed position in response to the wellbore fluid flow through the housing. The door is configured to slide axially in a second direction, opposite the first direction, to transition the door from the closed position to the open position in response to stopping the wellbore fluid flow through the housing.

An aspect, combinable with any other aspect, includes the following features. The assembly includes a gate member coupled to the housing and a spring coupled to the gate member. In the absence of the wellbore fluid flow through the housing, the gate member is in a closed position. In response to the wellbore fluid flow through the housing, the gate member transitions from the closed position of the gate member to an open position of the gate member and biases the spring. Upon stoppage of the wellbore fluid through the housing, the biased spring transitions the gate member from the open position of the gate member to the closed position of the gate member.

An aspect, combinable with any other aspect, includes the following features. The gate member is a plate arranged radially relative to a longitudinal axis of the housing.

An aspect, combinable with any other aspect, includes the following features. The assembly includes a receptacle attached to a first end of the housing. The receptacle is configured to receive magnetic items that fall vertically downward upon being released from the magnet.

An aspect, combinable with any other aspect, includes the following features. The magnet is a primary magnet. The receptacle includes multiple secondary magnets attached to an inner wall of the receptacle.

An aspect, combinable with any other aspect, includes the following features. Each secondary magnet is a magnetic bar having an end attached to the inner wall of the receptacle and extending radially inward from the inner wall of the receptacle.

An aspect, combinable with any other aspect, includes the following features. The receptacle is a hollow barrel attached to an end of the magnet.

An aspect, combinable with any other aspect, includes the following features. The assembly includes a tube attached to a second end of the housing. The tube is configured to be fluidically coupled to the wellbore tubing and to flow the wellbore fluid from the wellbore tubing into the housing.

An aspect, combinable with any other aspect, includes the following features. The assembly includes multiple first fluid flow openings formed in a wall of the housing at the second end. The multiple first fluid flow openings are configured to flow the wellbore fluid flowed through the wellbore tubing into a region in the housing. The tube is fluidically coupled to the region.

An aspect, combinable with any other aspect, includes the following features. The assembly includes a casing drift configured to be positioned between the wellbore tubing and the magnet. The tube is formed through the casing drift.

An aspect, combinable with any other aspect, includes the following features. The assembly includes a casing brush attached to an outer surface of the casing drift and extending radially away from a longitudinal axis of the housing.

An aspect, combinable with any other aspect, includes the following features. The assembly includes multiple second fluid flow openings formed in the receptacle. The multiple second fluid flow openings are configured to flow the wellbore fluid received in the receptacle into the wellbore tubing.

An aspect, combinable with any other aspect, includes the following features. The system includes multiple nozzles coupled to the housing. The multiple nozzles face the magnet. The multiple nozzles are configured to flow the wellbore fluid received through the diverter tube onto the magnet.

Certain aspects of the subject matter described here can be implemented as a method. Wellbore fluid, which is flowed through a wellbore from a surface of the wellbore, is flowed through an uphole end of a housing positioned within a wellbore and through a wellbore tubing disposed within the wellbore. The housing defines an interior volume and an opening on a circumferential surface of the housing. In response to receiving the wellbore fluid through the uphole end of the housing, a door, which is positioned within the housing, is transitioned from an open position to a closed position. In response to transitioning the door to the closed position, the door isolates a magnet disposed in the interior volume of the housing.

An aspect, combinable with any other aspect, includes the following features. Flow of the wellbore fluid through the uphole end of the housing is ceased to be received. In response, the door is transitioned from the closed position to an open position to expose the magnet to the wellbore.

An aspect, combinable with any other aspect, includes the following features. When the door is in the closed position, multiple nozzles coupled to the housing flow a portion of the wellbore fluid onto the magnet. A pressure of the portion of the wellbore fluid flowed onto the magnet causes the magnet to release magnetic particles attached to the magnet.

An aspect, combinable with any other aspect, includes the following features. A receptacle, which is attached to a downhole end of the housing, receives the magnetic items released from the magnet.

An aspect, combinable with any other aspect, includes the following features. A casing drift is positioned between the wellbore tubing and the magnet. To flow the wellbore fluid through the uphole end of the housing, a tube is formed in the casing drift. The tube extends through the casing drift from the uphole end of the housing to an uphole end of the magnet. The wellbore fluid is flowed by the tube through the housing.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Wellbore cleanout operations can be performed by deploying a number of string magnets (i.e., multiple magnets connected serially to a wellbore tubing), junk basket (or baskets) mounted to a downhole end of the string magnets to capture debris captured by the magnets, and brushes mounted to a circumferential wall of the wellbore tubing to clean the inner walls of the wellbore. Such operations are performed prior to deploying well completions. In some instances, rig operators deploy the wellbore cleanout magnet multiple times (e.g., three to four wellbore cleanout runs) to prepare the wellbore for completion. A quantity of debris that the magnet can capture within the wellbore depends, in part, on a surface area of the magnet. Often, the wellbore cleanout magnet tool needs to be removed from within the wellbore to remove the debris from the magnet before the tool can be run into the wellbore for another cleaning run.

This disclosure describes a wellbore tool assembly, specifically, a wellbore cleanout magnet tool, that has an enclosed magnet that can be exposed to or isolated from a wellbore environment by wellbore fluid flow. The tool described in this disclosure is designed and constructed to permit periodic removal of the captured debris (i.e., magnetic items) from the surface of the magnet while the magnet is retained in the wellbore and without needing to retrieve the tool from within the wellbore. In this manner, an operational efficiency of the tool can be improved, and the time taken to perform cleanout operations using the tool can be decreased. Moreover, the configuration of this tool includes a junk basket located below the super enclosed magnet to collect all the debris falling from the magnet as the flow is pumped. The junk basket can accommodate all sizes of metallic junk in the wellbore. In conventional cleanout operation, string magnet is run multiple times hindering the efficiency of the operation and increase the flat time of operation. This proposed tool will achieve wellbore cleanout objective in one trip.

Figure 1:
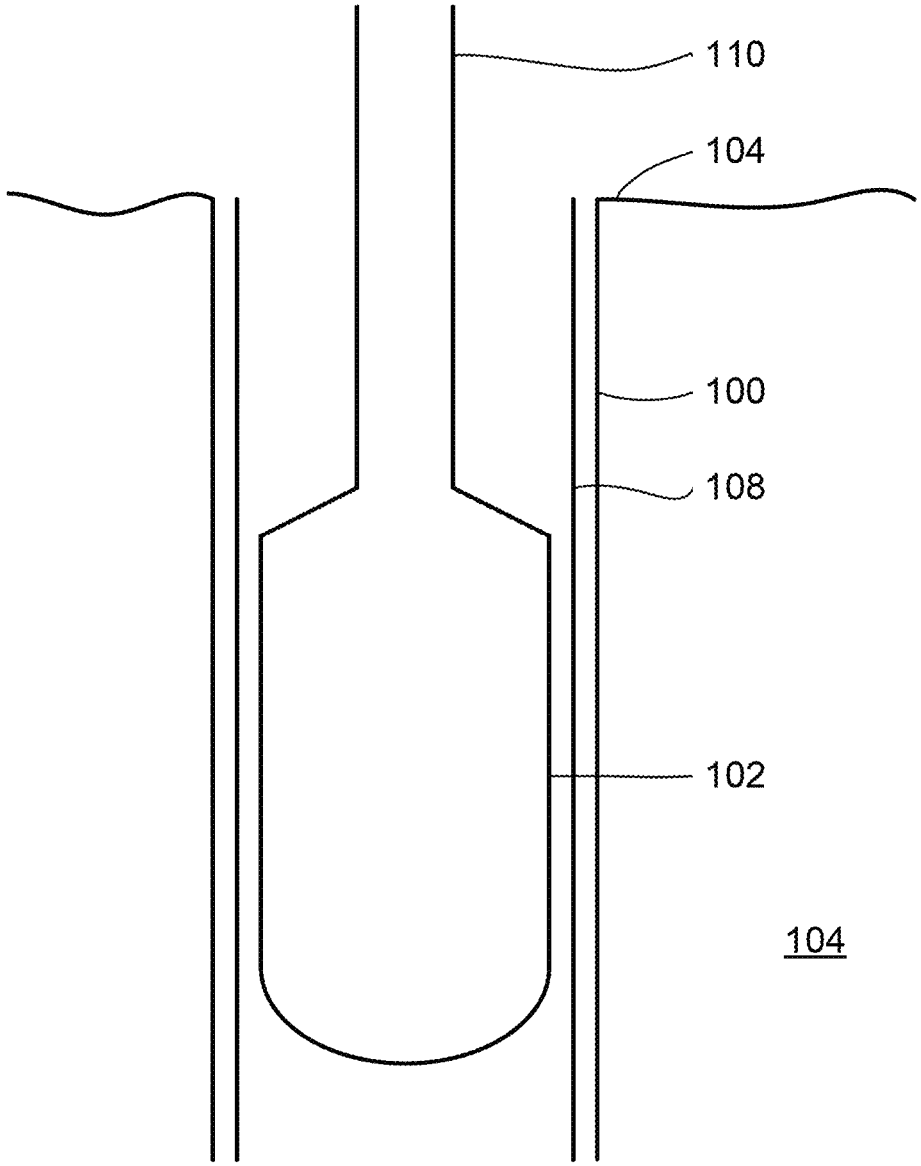
FIG. 1 is a schematic diagram of an example of a wellbore in which an example of a wellbore cleanout magnet tool has been deployed.
Figure 2A:
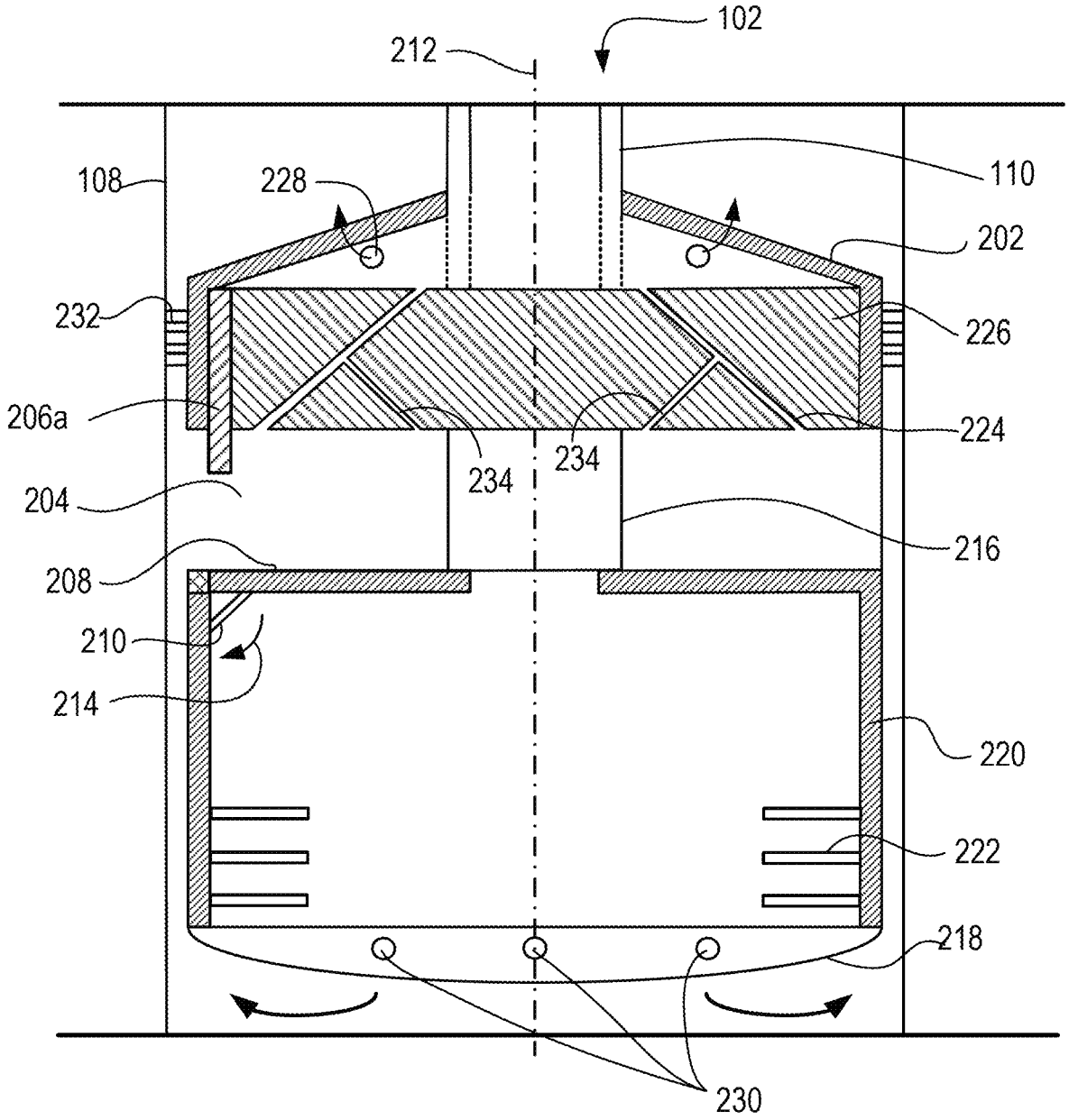
FIGS. 2A and 2B are schematic diagrams of the tool of FIG. 1.
Figure 2B:
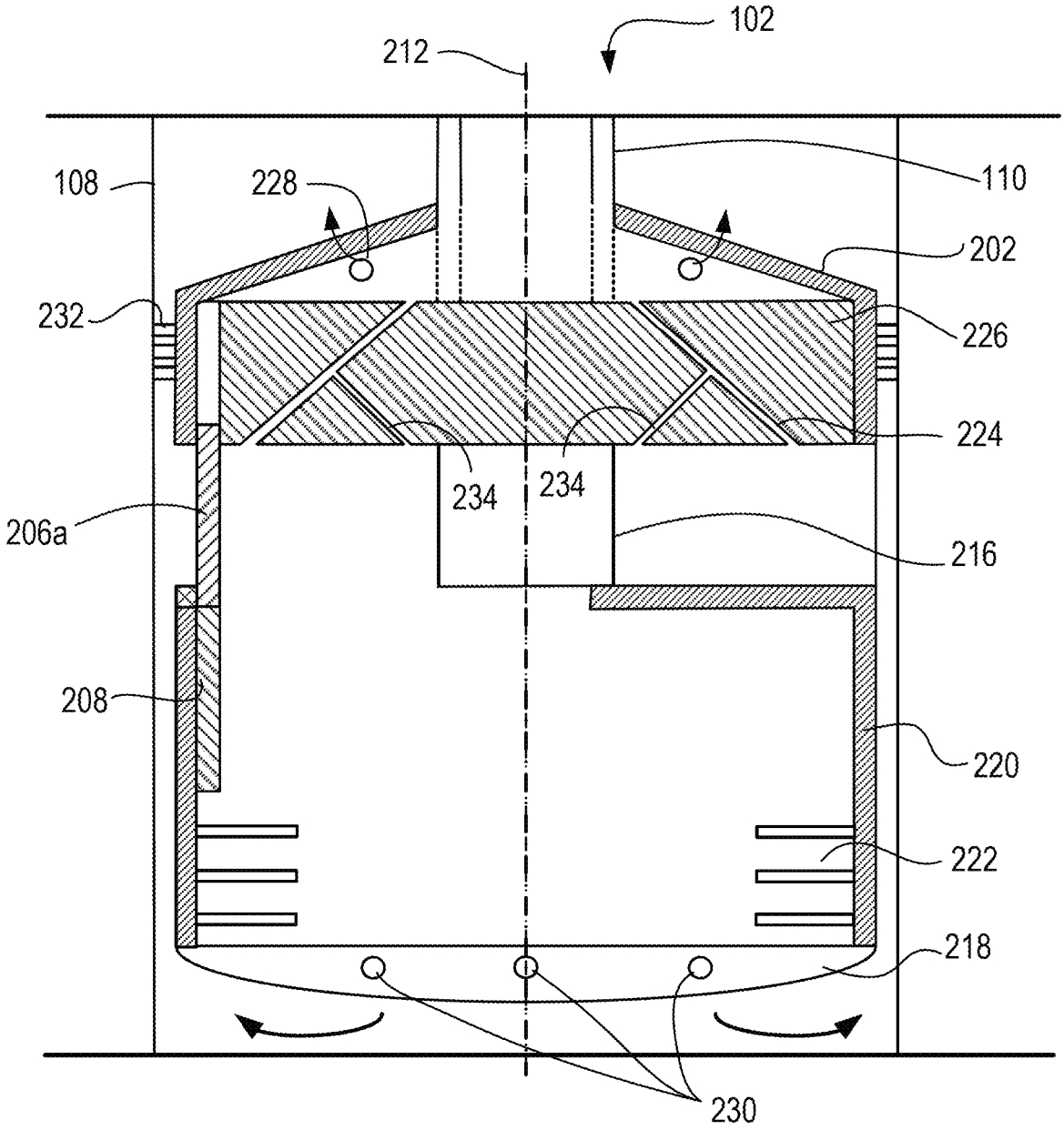
Figure 2C:
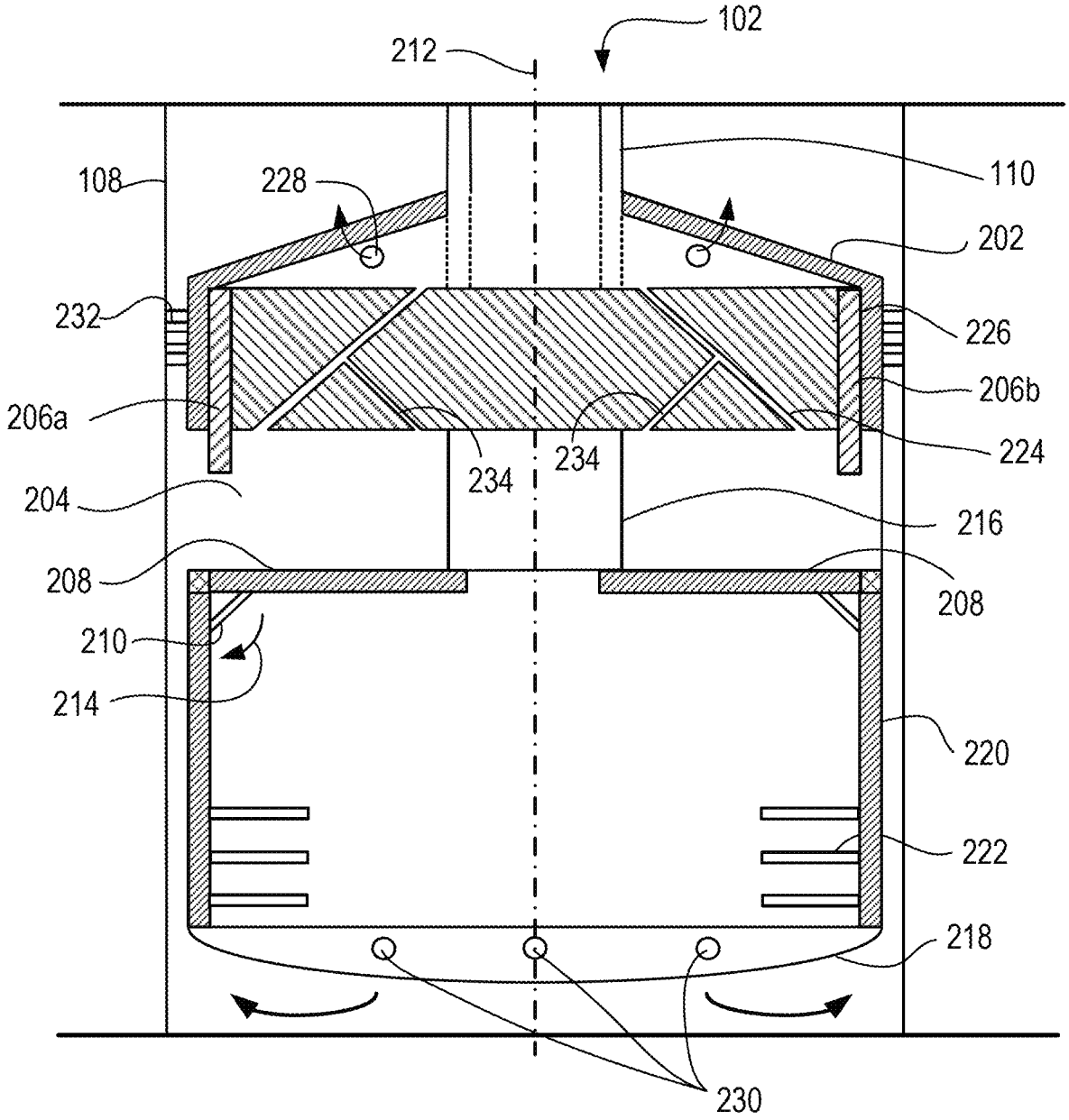
FIGS. 2C and 2D are schematic diagrams of another implementation of the tool of FIG. 1.
Figure 2D:
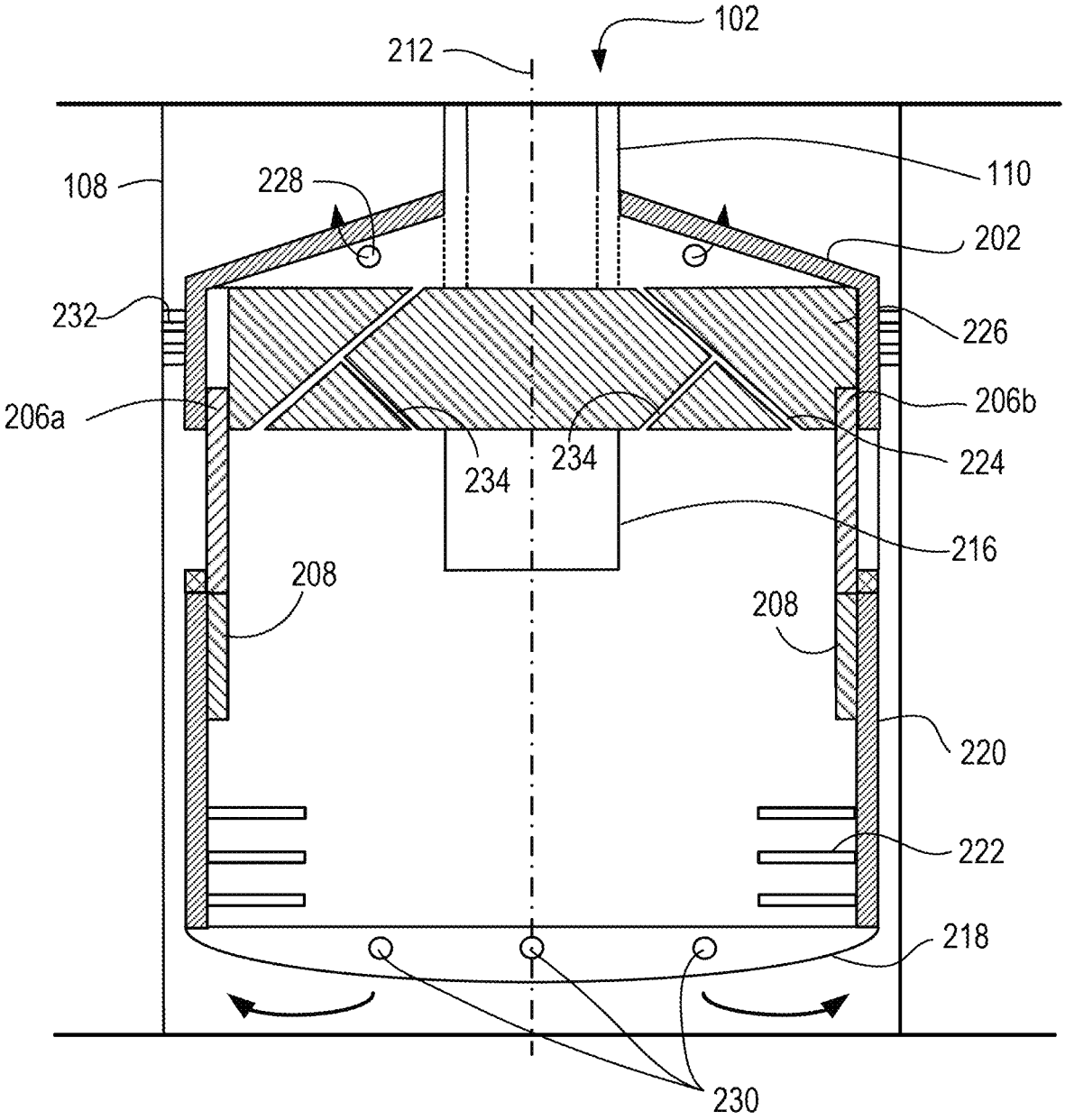

FIG. 1 is a schematic diagram of an example of a wellbore 100 in which an example of a wellbore cleanout magnet tool 102 has been deployed. The wellbore 100 is formed in a subterranean zone 104 and extends from a surface 106 through the subterranean zone 104. The wellbore 100 can be formed by wellbore drilling operations. All or portions of the wellbore 100 can be cased. For example, a casing string 108, which is a length of wellbore tubing, is lowered into the wellbore 100. Then, cement is flowed from the surface 106 through the casing string 108 and into the annulus formed between an outer wall of the casing string 108 and an inner wall of the wellbore 100 to install the casing string 108 in the wellbore 100. The process can be repeated to install multiple lengths of casing string in the wellbore 100. After installing any casing string 108 in the wellbore 100, the tool 102 can be lowered into the casing string 108 by coupling an uphole end of the tool 102 to an end of a length of wellbore tubing 110, and lowering the tubing 110 into the casing string 108. As described below with reference to FIGS. 2A-2D, the tool 102 includes an enclosed magnet that can be exposed to or isolated from an environment within the wellbore 100, specifically an environment within the casing string 108, to capture debris (i.e., magnetic items) that may have fallen into the wellbore 100 during any wellbore operation. As described with reference to FIG. 3, operations can be performed to periodically separate the captured debris from the magnet so that the cleanout operations (i.e., the operations to capture additional magnetic items) can be performed without needing to remove the tool 102 from within the casing string 108.

FIGS. 2A-2D are schematic diagrams of implementations of the tool 102 of FIG. 1. The parts of the tool 102 are described with reference to FIGS. 2A-2D. The materials from which the parts can be made have properties suitable for use in downhole conditions. For example, the materials can survive and operate as intended under extreme pressure and temperature that are encountered in the subterranean zone.

In some implementations, the tool 102 includes a housing 202 that can be connected to a wellbore tubing, for example, the wellbore tubing 110. The housing 202 is hollow and defines an interior volume. The housing 202 includes an opening 204 (FIG. 2A) on a circumferential surface of the housing 202. The opening 204 can be formed by removing a portion of a circumferential wall of the housing 202. The opening 204 is a through-hole. The opening 204 exposes the interior volume of the housing 202 to an environment outside the housing 202, for example, to the wellbore 100, and specifically to the casing string 108.

In some implementations, the tool 102 includes a door 206*a* positioned within the housing 202. The door 206*a* can transition between an open position and a closed position. In a default state (FIG. 2A), the door 206*a* is the open position in which the interior volume of the housing 202 is exposed to the environment outside the housing 202. In the default state, fluid (e.g., wellbore fluid) is not flowed through the housing 202, and the door 206*a* is open. In an operational state (FIG. 2B), the door 206*a* is in the closed position in which the interior volume of the housing 202 is isolated from the environment outside the housing 202. In the operational state, fluid (e.g., wellbore fluid) is flowed through the housing 202, and the door 206*a* is closed.

In some implementations (FIGS. 2A, 2B), the housing 202 has one opening 204, and the tool 102 includes one door 206*a*, which is arranged and constructed to align with and completely cover the opening 204 when the door 206*a* is in the closed state. In some implementations (FIGS. 2C, 2D), the housing 202 can have more than one opening, and the tool 102 can include more than one door (e.g., a first door 206*a*, a second door 206*b*), each of which is arranged and constructed to align with and completely cover a respective opening when the door is in the closed state.

In some implementations (FIGS. 2A, 2B), the door 206*a* can slide axially relative to the housing 202 in a first direction (e.g., in a downhole direction away from the surface 104 of the wellbore 100) to transition the door 206*a* from the open position to the closed position in response to the flow of wellbore fluid through the housing 202. Similarly, the door 206*a* can slide axially relative to the housing 202 in a second direction, opposite the first direction (e.g., in an uphole direction toward the surface 104 of the wellbore 100) to transition the door 206*a* from the closed position to the open position in response to the flow of wellbore fluid through the housing 202. In implementations in which the tool 102 has more than one door (FIGS. 2C, 2D), each door can operate similarly to the door 206*a*.

The door 206*a* transitions between the open state and the closed state, as described above, due to operations of a gate member 208 and a spring 210 coupled to the gate member 208. The gate member 208 is coupled to the housing 202. For example, the gate member 208 is a plate arranged radially relative to a longitudinal axis 212 of the housing 202. When the housing 202 is deployed in the wellbore 100 as described in this disclosure, the longitudinal axis 212 of the housing 202 aligns with a longitudinal axis (not shown) of the wellbore 100 and a longitudinal axis (not shown) of the casing string 108.

Returning to the gate member 208, an end of the plate is coupled to an inner wall of the housing 202. The gate member 208 extends towards a center of the housing 202 in a direction perpendicular to the longitudinal axis 212 of the housing 202. The end of the gate member 208 that is connected to the inner wall of the housing 202 is hinged such that, in response to a force, the gate member 208 can pivot about the hinged end. When pivoting, the end of the gate member 208 that is not hinged swings away from the longitudinal axis 212 of the housing 202 towards the inner wall of the housing 202 in an arc represented by the arrow 214.

In some implementations (FIGS. 2C, 2D), the tool 102 can include two gate members, each similar to the gate member 208, each formed having a semi-circular cross-section that complements the semi-circular cross-section of the other gate member 208. When positioned together, the two gate members form a circular plate that has a diameter equal to an inner diameter of the housing 202. In such implementations, each gate member has a circular edge and a straight edge. The circular edge is hinged (at one or more locations) to the inner wall of the housing 202. The straight edge is free and can swings in the arc, as described above, in response to the force.

The force that causes the gate member 208 to swing about the hinged end is generated by a wellbore fluid flowing through the housing 202. In the absence of the wellbore fluid flow through the housing 202, the gate member 208 is in a closed position, i.e., the gate member 208 extends radially inward toward the longitudinal axis 212 of the housing 202. In response to the wellbore fluid flowing through the housing 202, the gate member 208 transitions from the closed position to an open position. In the open position of the gate member 208, the gate member 208 swings away from the longitudinal axis 212 of the housing 202 towards the inner wall of the housing 202 in the arc represented by the arrow 214.

As mentioned above, the spring 210 is coupled to the gate member 208. When the gate member 208 is in the closed position, the spring 210 is unbiased (e.g., not compressed or not storing potential energy). Specifically, the spring 210 is positioned between the gate member 208 and the inner wall of the housing 202 such that the transition from the closed position of the gate member 208 to the open position of the gate member 208 biases the spring 210. The pressure of the wellbore fluid flowing through the housing 202 provides the force required to keep the spring 210 biased. In the biased position, the spring 210 is compressed or stores potential energy. When the wellbore fluid flow through the housing 202 is ceased, then no force or a comparatively reduced force is applied on the gate member 208. The biased spring 210 naturally tends to return to its unbiased state causing the spring 210 to extend and move the gate member 208 from the open position of the gate member 208 to the closed position of the gate member 208.

A magnet 216 is disposed in the interior volume defined by the housing 202. As described above, in the absence of fluid flow through the housing, the door 206*a* exposes the opening 204 on the circumferential surface of the housing 202. In that arrangement, the magnet 216 is exposed to an environment within the wellbore 100, specifically an environment within the casing string 108. Also, as explained above, the state of the housing 202 in which the door 206*a* is in the open position is a default state. Thus, in the default state of the housing 202, the magnet 216 is exposed to the environment outside the interior volume of the housing 202. The state of the housing 202 in which the door 206*a* is in the closed position is an operational state. In the operational state of the housing 202, the magnet 216 is isolated from the environment outside the interior volume of the housing 202.

A receptacle 218 is attached to a first end, e.g., a downhole end, of the housing 202. For example, the receptacle 218 is a hollow barrel attached to an end of the magnet. Alternatively or in addition, the receptacle 218 can be attached vertically below the gate member 208. The receptacle 218 can receive, i.e., catch, debris, i.e., magnetic items, that fall vertically downward upon being released from the magnet 216. In some implementations, the receptacle 218 includes a circumferential wall 220. Multiple secondary magnets (e.g., a magnetic bar 222) are attached to an inner surface of the circumferential wall 220 and extend radially inward from the inner surface. Each secondary magnet can also capture magnetic items within the wellbore 100. Also, when captured debris is separated from the magnet 216, the falling magnetic items can be captured by the secondary magnets within the receptacle 218, while any non-magnetic items fall to the bottom of the receptacle 218. When the tool 102 is retrieved from within the wellbore 102, the debris can be sorted into magnetic items captured by the secondary magnets and debris that has fallen to the bottom of the receptacle 218.

As described earlier, the wellbore tubing 110 is connected to an end (e.g., an uphole end) of the tool 102 and is used to lower the tool 102 into the casing string 108. In some implementations, the wellbore tubing 110 runs to the surface 104 of the wellbore 100 and is fluidically coupled to a wellbore fluid pump (not shown) which draws wellbore fluid (e.g., drilling mud) from mud tanks (not shown) to flow through the wellbore tubing 110. In this manner, the wellbore tubing 110 flows the wellbore fluid that provides the pressure (i.e., the motive force) to move the parts of the tool 102 as described above.

In some implementations, the tool 102 includes a tube 224 (e.g., a diverter tube) that is fluidically coupled to the wellbore tubing 110 and that flows the wellbore fluid received from the wellbore tubing 110 through the interior volume defined by the housing 202. For example, the tool 102 includes a casing drift 226 that is positioned between the wellbore tubing 110 and the magnet 216. The tube 224 is formed through the casing drift 226. In some implementations, multiple tubes can be formed through the casing drift 226, for example, from an uphole end of the casing drift 226 that is nearer to the uphole end of the housing 202 to a downhole end of the casing drift 226 that is nearer to the downhole end of the housing 202.

In some implementations, the tool 102 includes multiple fluid flow openings 228 formed in a wall of the housing 202 at the second end, i.e., the uphole end of the housing 202. Each flow opening 228 is a through-hole that can flow the wellbore fluid flowed through the wellbore tubing 110 and through the tool 102 into a region in the housing 202. The tube 224 is fluidically coupled to the region. For example, the multiple fluid flow openings 228 are formed in a space between the top of the casing drift 226 and the downhole end of the wellbore tubing 110. Similarly, the tool 102 includes multiple fluid flow openings 230 formed in a wall of the housing 202 at the first end, i.e., the downhole end of the housing 202. Each flow opening 230 is a through-hole that can flow the wellbore fluid flowed through the housing 202 into a region downhole of the tool 102. For example, the wellbore fluid that flows through the tube 224 passes through the housing 202, past the magnet 216, past the open gate member 208, into the receptacle 220 and out of the multiple fluid flow openings 230.

In some implementations, the tool 102 includes multiple nozzles 234. The multiple nozzles 234 face the magnet 216. The nozzles 234 can flow the wellbore fluid that flows through the tool 202 onto a surface of the magnet 216. The nozzles 234 can pressurize and increase a flow rate of the wellbore fluid to a level sufficient to overcome the magnetic force with which the magnet 216 retains the magnetic items. By doing so, the nozzles 234 enable the magnetic items to separate from the magnet 216 and fall vertically below into the receptacle 220. A number of nozzles 234 can vary based on the size of the tool 102.

In operation, a wellbore operator couples the tool 102 to an end of the wellbore tubing 110, and lowers the tool 102 into the casing string 108. Because the tool 102 is in its default state, i.e., the state in which the door **206*a* is open and the magnet 216 is exposed to the environment outside the housing 202, the magnet 216 attracts debris inside the casing string 108. In some implementations, a casing brush 232 is attached to an outer surface of the housing 202 or the casing drift 226. The casing brush 232 extends radially away from the longitudinal axis 212 of the housing 202. The casing brush 232 is long enough to contact the inner wall of the casing string 108. The wellbore operator can alternately lower and raise the wellbore tubing 110 to cause the casing brush 232 to brush and release magnetic items attached to the inner wall of the casing string 108. The exposed magnet 216** can capture such magnetic items.

Then, the wellbore operator initiates an operation to clean the magnet 216, i.e., to separate the captured magnetic items from the magnet 216. To do so, the wellbore operator starts a pump (not shown) that pumps the wellbore fluid (e.g., the drilling mud, completion fluid such as brine) through the wellbore tubing 110. The wellbore fluid flows through the wellbore tubing 110 into the uphole end of the housing 202. The tube 224 flows at least a portion of the fluid from the uphole end of the housing 202 towards the door **206*a*. The diameter of the tube 224 is selected such that the wellbore fluid is pressurized and its flow rate increases as it exits the tube 224. The high flow rate wellbore fluid applies pressure on the door 206*a* causing the door 206*a* to slide axially relative to the housing 202 in the downhole direction. When the door 206*a* slides in the downhole direction, the door 206*a* covers the opening 204 which exposes the magnet 216 to the environment outside the housing 202. As the door 206*a* slides in the downhole direction, the door 206*a* applies a force on the gate member 208, which overcomes the force of the biased spring 210 causing the gate member 208 to swing and open. In this arrangement, the magnet 216 is isolated from the environment outside the housing 202, and the open gate member 208 permits access to the receptacle 220 that is downhole of the magnet 216**.

As described earlier, the multiple nozzles 234 are positioned/formed in the door **206*a* of the housing 202. The wellbore fluid flowing through the housing 202 is pressurized by the multiple nozzles 232, and jets of wellbore fluid are directed onto the magnet 216. The force of the jets overcomes the magnetic force of attraction holding the magnetic items to the magnet 216. The released magnetic items fall vertically downward into the open receptacle 220**.

After flowing the wellbore fluid through the tool 102 as described above for a duration, e.g., a duration long enough to release the magnetic items into the open receptacle 220, the wellbore operator ceases the fluid flow, e.g., by stopping the pump. The wellbore fluid drains out of the tool 102 through the multiple fluid flow openings (228, 230). An absence of fluid flow causes the biased spring 210 to return to its unbiased state. When doing so, the spring 210 pushes the gate member 208 from the open position to the closed position. In turn, the gate member 210 pushes the door **206*a* from the closed position to the open position. The door 206*a* slides upwards in an inclined position when the pump is on (flood force). Once the pump is off, then the force is removed and the door 206*a* slides back to open position. With the door 206*a* in the open position, the magnet 216 is once again exposed to the environment outside the housing 202 and can be lowered to a next depth within the wellbore 100** to capture more debris.

Figure 3:
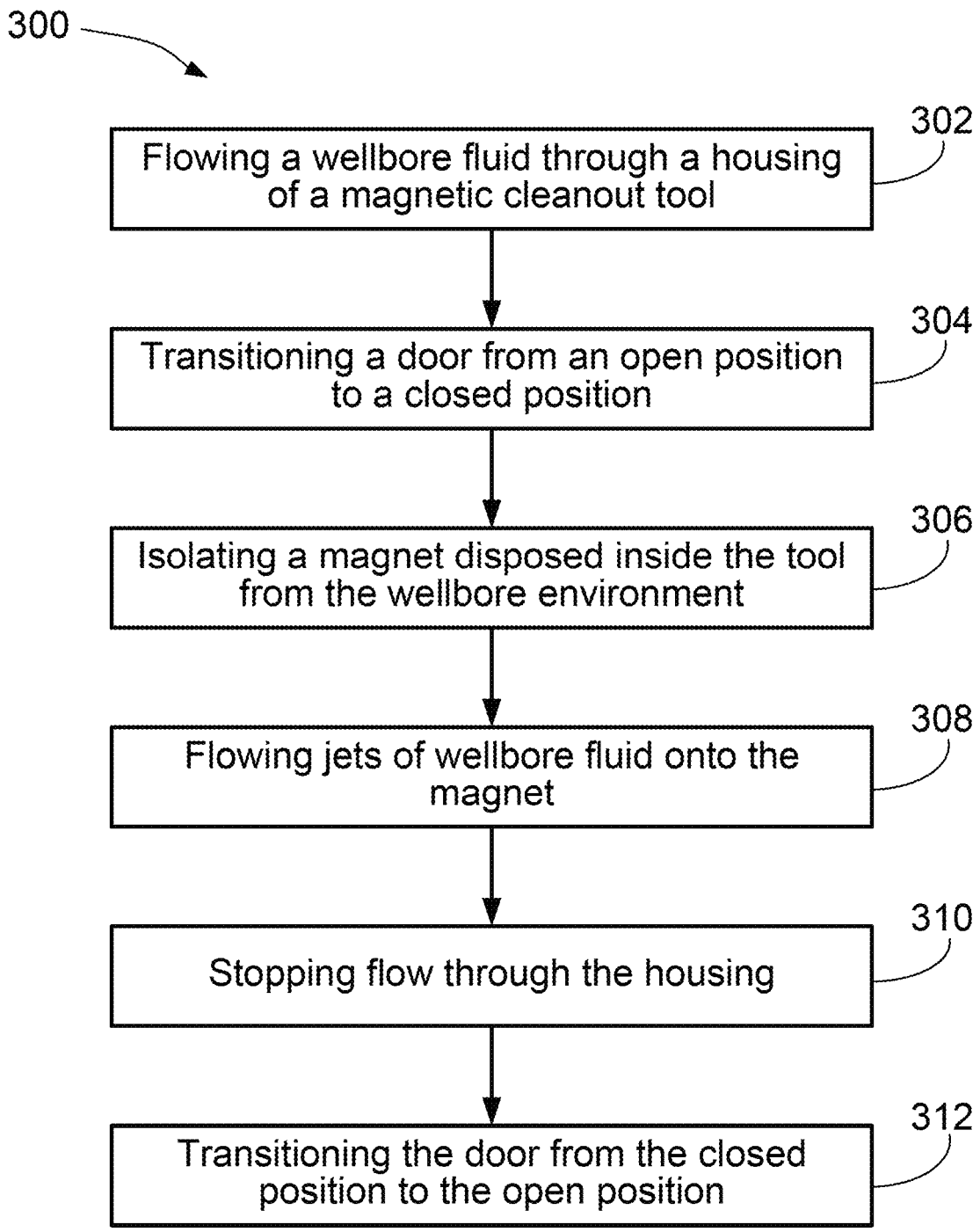
FIG. 3 is a flowchart of an example of a process of using the tool of FIG. 1.

FIG. 3 is a flowchart of an example of a process 300 of using the tool of FIG. 1. Certain steps of the process 300 can be implemented by the components described above. Certain steps of the process 300 can be implemented by a wellbore operator. At 302, a wellbore fluid is flowed through a housing of a magnetic cleanout tool. For example, drilling mud is flowed through an uphole end of the housing 202 positioned within the wellbore 100 and through a wellbore tubing 110 disposed within the wellbore 100. The wellbore tubing 100 runs from the surface 104 of the wellbore 100 to the uphole end of the housing 202 that is disposed at a depth at which magnetic cleanout operations are to be performed. At 304, a door of the magnetic cleanout tool is transitioned from an open position to a closed position. For example, in response to receiving the drilling mud through the uphole end of the housing 202, the door 206*a* transitions from an open position (in a default state) to a closed position (in an operational state).

At 306, a magnet disposed inside the tool is isolated from the wellbore environment. For example, in response to the door 206*a* transitioning from the open position to the closed position, the door 206*a* closes the opening 204 in the housing 202. The closed door 206*a* isolates the magnet 216 positioned within the housing 202 from the environment outside the housing 202. At 308, jets of wellbore fluid are flowed onto the magnet 216. For example, the door 206*a* includes nozzles or openings that flow the drilling mud flowed from the surface 104 onto the surface of the magnet 216. Doing so causes magnetic items captured by the magnet 216 to be separated and to fall into the receptacle 220 below the magnet 216. At 310, flow through the housing is stopped. For example, the pumps that flow the drilling mud through the wellbore tubing 110 are stopped. At 312, the door is transitioned from the closed position to the open position. For example, an absence of the drilling mud pressure causes the door to transition from the closed position to the open position, exposing the magnet 216 to the environment outside the housing 202.

Thus, particular implementations of the subject matter have been described. Other implementations are within the scope of the following claims.

The invention claimed is:

1. A wellbore tool assembly comprising:

a housing configured to be connected to a wellbore tubing, the housing defining an interior volume and an opening on a circumferential surface of the housing;

a door positioned within the housing, the door configured to transition between an open position in an absence of wellbore fluid flow through the housing and a closed position in a presence of the wellbore fluid flow through the housing; and a magnet disposed in the interior volume, wherein, in the absence of the wellbore fluid flow through the housing, the door exposes the opening on the circumferential surface of the housing and the magnet to an environment outside the housing, and, in the presence of the wellbore fluid flow through the housing, the door closes the opening on the circumferential surface of the housing and isolates the magnet from the environment.

2. The assembly of claim 1, wherein the door is configured to slide axially relative to the housing in a first direction to transition the door from the open position to the closed position in response to the wellbore fluid flow through the housing, and to slide axially in a second direction, opposite the first direction, to transition the door from the closed position to the open position in response to stopping the wellbore fluid flow through the housing.

3. The assembly of claim 2, further comprising:

a gate member coupled to the housing; and a spring coupled to the gate member, wherein, in the absence of the wellbore fluid flow through the housing, the gate member is in a closed position, and in response to the wellbore fluid flow through the housing, the gate member transitions from the closed position of the gate member to an open position of the gate member and biases the spring, wherein, upon stoppage of the wellbore fluid through the housing, the biased spring transitions the gate member from the open position of the gate member to the closed position of the gate member.

4. The assembly of claim 3, wherein the gate member is a plate arranged radially relative to a longitudinal axis of the housing.

5. The assembly of claim 1, further comprising a receptacle attached to a first end of the housing, wherein the receptacle is configured to receive magnetic items that fall vertically downward upon being released from the magnet.

6. The assembly of claim 5, further comprising a plurality of nozzles coupled to the housing, the plurality of nozzles facing the magnet, the plurality of nozzles configured to flow the wellbore fluid received through a diverter tube onto the magnet.

7. The assembly of claim 5, wherein the magnet is a primary magnet, wherein the receptacle comprises a plurality of secondary magnets attached to an inner wall of the receptacle.

8. The assembly of claim 7, wherein each secondary magnet is a magnetic bar having an end attached to the inner wall of the receptacle and extending radially inward from the inner wall of the receptacle.

9. The assembly of claim 5, wherein the receptacle is a hollow barrel attached to an end of the magnet.

10. The assembly of claim 5, further comprising a tube attached to a second end of the housing, wherein the tube is configured to be fluidically coupled to the wellbore tubing and configured to flow the wellbore fluid from the wellbore tubing into the housing.

11. The assembly of claim 10, further comprising a first plurality of fluid flow openings formed in a wall of the housing at the second end, wherein the first plurality of fluid flow openings are configured to flow the wellbore fluid flowed through the wellbore tubing into a region in the housing, wherein the tube is fluidically coupled to the region.

12. The assembly of claim 11, further comprising a casing brush attached to an outer surface of the casing drift and extending radially away from a longitudinal axis of the housing.

13. The assembly of claim 11, further comprising a second plurality of fluid flow openings formed in the receptacle, wherein the second plurality of fluid flow openings are configured to flow the wellbore fluid received in the receptacle into the wellbore tubing.

14. The assembly of claim 10, further comprising a casing drift configured to be positioned between the wellbore tubing and the magnet, wherein the tube is formed through the casing drift.

15. A method comprising:

flowing, through an uphole end of a housing positioned within a wellbore and through a wellbore tubing disposed within the wellbore, a wellbore fluid flowed through the wellbore from a surface of the wellbore, wherein the housing defines an interior volume and an opening on a circumferential surface of the housing;

in response to receiving the wellbore fluid through the uphole end of the housing, transitioning a door positioned within the housing from an open position, wherein the opening is open, to a closed position, wherein the opening is closed, thus isolating, by the door, a magnet disposed in the interior volume of the housing.

16. The method of claim 15, further comprising:

ceasing to receive flow of the wellbore fluid through the uphole end of the housing; and in response to ceasing to receive the flow of the wellbore fluid, transitioning the door from the closed position to an open position to expose the magnet to the wellbore.

17. The method of claim 16, further comprising, when the door is in the closed position, flowing, by a plurality of nozzles coupled to the housing, a portion of the wellbore fluid onto the magnet, wherein a pressure of the portion of the wellbore fluid flowed onto the magnet causes the magnet to release magnetic particles attached to the magnet.

18. The method of claim 17, further comprising, receiving, by a receptacle attached to a downhole end of the housing, the magnetic items released from the magnet.

19. The method of claim 15, wherein a casing drift is positioned between the wellbore tubing and the magnet, wherein flowing, through the uphole end of the housing the wellbore fluid flowed through the wellbore from the surface of the wellbore, comprises:

forming a tube in the casing drift, the tube extending through the casing drift from the uphole end of the housing to an uphole end of the magnet; and flowing, by the tube, the wellbore fluid through the housing.

* * * * *